US005996131A

United States Patent [19]

Vallair

[11] Patent Number: 5,996,131

[45] Date of Patent: Dec. 7, 1999

[54] COMMODE VENTILATION SYSTEM

[76] Inventor: Joe N. Vallair, 1419 Kenforest, Missouri City, Tex. 77489

[21] Appl. No.: 09/149,498

[22] Filed: Sep. 8, 1998

[51] Int. Cl.[6] ..... E03D 9/04

[52] U.S. Cl. ..... 4/213; 4/209 R

[58] Field of Search ..... 4/213, 209 R, 4/217, 214, 215, 216, 218

[56] References Cited

U.S. PATENT DOCUMENTS

| | | | |
|---|---|---|---|
| 1,972,076 | 9/1934 | Cross | 4/213 |
| 2,171,903 | 9/1939 | Aubin | 4/213 |
| 3,332,089 | 7/1967 | Wilton | 4/213 |
| 3,534,415 | 10/1970 | Huffman | 4/213 |
| 4,094,023 | 6/1978 | Smith | 4/213 |
| 5,105,479 | 4/1992 | Ross | 4/213 |
| 5,136,729 | 8/1992 | Ricard | 4/213 |
| 5,179,737 | 1/1993 | Ricard | 4/213 |
| 5,199,111 | 4/1993 | Antepenko | 4/213 |
| 5,253,371 | 10/1993 | Slawinski | 4/213 |
| 5,321,856 | 6/1994 | Gastesi | 4/213 |
| 5,745,927 | 5/1998 | Hoareau | 4/213 |

*Primary Examiner*—David J. Walczak
*Attorney, Agent, or Firm*—Joseph N. Breaux

[57] ABSTRACT

A Commode Ventilation System which comprises a toilet seat having a resilient gasket manifold attached to an under surface of the toilet seat and includes a number of rigid spacer members and a number of passage ways therein forming the manifold which passage ways are in connection with a number of intake orifices positioned on an interior perimeter surfaces of the manifold in a manner such that in use the resilient manifold gasket seals the gap between the toilet seat and the commode bowl top rim. The manifold chambers in communication with a vent that is used to draw air from the commode bowl through the intake orifices to the manifold and out to a desired disposal area.

1 Claim, 2 Drawing Sheets

COMMODE VENTILATION SYSTEM

TECHNICAL FIELD

The present invention relates to devices and methods for commode ventilation and more particularly to devices and methods for a commode ventilation system that comprises a toilet seat having a resilient gasket attached to the under surface thereof that includes a number of rigid spacer members and a manifold formed therein and in connection with a number of intake orifices formed on interior side surfaces thereof in a manner such that in use, the resilient gasket seals the gap between the seat and the commode bowl. The manifold chamber is in connection with a vent tube that is used to draw air from the commode bowl through the intake orifices to the manifold and out to a desired disposal area.

BACKGROUND ART

There have been numerous systems disclosed for removing noxious odors from commodes and bathroom spaces. Such systems usually involve a vent located in the bathroom and either mounted on the bathroom ceiling or wall, while ventilation systems have also been designed and used in conjunction with a commode. The disadvantages and drawbacks of the prior art is that the typical system is not positioned in close proximity to the odor source, namely the commode bowl. Accordingly, the prior art devices require the removal of large volumes of air in order to accomplish the goal of removing odors from the bathroom. Furthermore, the prior art devices which are installed adjacent to the commode bowl do not provide a perimeter air withdraw manifold as the present invention and these prior art devices do not effectively capture all noxious odors emanating from the commode bowl.

The prior art patents are as follows:

Ross, U.S. Pat. No. 5,105,479 discloses a simple low cost means for venting a water closet. This device has a single ventilation housing opening for receiving gases positioned between the toilet lid and seat. The Ross device does not provide a perimeter air removal system as the present invention and accordingly does not effectively collect all odors emanating from the toilet bowl as the present invention.

Ricard, U.S. Pat. No. 5,136,729 and U.S. Pat. No. 5,179,737 discloses an odor remover device which includes a single inlet opening mounted to the conventional hinge posts of the toilet bowl lid. This device, similarly to the Ross invention, includes only a single evacuation port for odors emanating from the toilet bowl. The present invention includes numerous air inlet ports positioned around the perimeter of the toilet bowl which more efficiently removes odors from the toilet bowl.

Antepenko, U.S. Pat. No. 5,199,111 discloses a toilet odor removing apparatus with exhaust fixtures mounted to the flat upper surface of a conventional toilet bowl behind the conventional toilet seat. This ventilation system is useful for its stated purposes however it does not provide for complete removal of odors emanating from a toilet bowl as the present invention which has numerous odor exhaust ports positioned around the perimeter of the toilet bowl.

Slawinski, U.S. Pat. No. 5,253,371 discloses a device for exhausting fowl odor from a toilet with a single intake hose positioned on the rim of the toilet bowl below the toilet seat. This device, as the others mentioned above, includes only one odor exhaust port and accordingly does not provide an odor removal system as the present which has numerous exhaust removal ports positioned around a perimeter of the toilet bowl.

Gastesi, U.S. Pat. No. 5,321,856 discloses a flush toilet exhaust system which draws air from a plurality of openings disposed about the toilet bowl rim which openings are in communication with the commodes water tank through the overflow pipe in the toilet water tank. This invention, like the present provides a method for withdrawing odors around a perimeter of the toilet bowl. Accordingly is a very effective for removing odors from the toilet bowl, however the Gastesi device withdraws air through the passage ways which must be used to allow water to run from the commode tank to the toilet bowl. Accordingly, the Gastesi device is unable to withdraw air while the commode is being flushed and since the exhaust fan operates while the commode is being flushed, water flow interrupts air flow through the passage ways thereby interfering with the normal function of the commode and or the exhaust system. The present invention provides a solution to the flushing and air flow interruptions by providing a perimeter manifold positioned between the toilet lid bottom surface and toilet bowl top rim perimeter with numerous inlets positioned on an inside edge between the toilet lid and the bowl top edge so that air is continuously withdrawn from the toilet bowl thereby removing all odors emanating from the toilet bowl.

As can be seen the present invention provides a useful device which is provided as an attachment for an existing toilet lid or provided as a new toilet lid with the unique feature attached and which is extremely useful for removing odors which are emanating from a toilet bowl while the commode ventilation system comprises a toilet seat having a resilient gasket attached to the under surface thereof and which includes a number of rigid spacer members and a manifold formed therewith in connection with a number of intake orifices formed on interior side surfaces thereof in a manner such that in use the resilient gasket seals the gap between the seat and the commode bowl. The manifold chamber is in connection with a common vent that is used to draw air from the commode bowl through the intake orifices to the manifold and out to a desired disposal area.

GENERAL SUMMARY DISCUSSION OF INVENTION

It is thus an object of the invention to provide a commode ventilation system that is inexpensive and easy to manufacture and easy to mount by simply replacing the toilet seat of a conventional toilet.

It is a further object of the invention to provide a commode ventilation system that permits an existing bathroom ventilation system to be connected directly to the commode ventilation system.

It is a still further object of the invention to provide a commode ventilation system that withdraws all odors emanating from a toilet bowl by providing numerous air inlet orifices positioned around a perimeter of the commode bowl so that all odors emanating up from the commode bowl are collected from the toilet bowl through the numerous air inlets and expelled by a common vent to a bathroom exhaust fan.

It is a still further object of the invention to provide a commode ventilation system that is attached to a under surface of a commode seat and forming a perimeter manifold between the toilet seat and the commode bowl upper edge and including numerous inlet ports positioned around the manifold so that odors emanating from the commode bowl are captured and withdrawn to an exterior vent.

Accordingly, a commode ventilation system is provided which comprises a toilet seat having a resilient gasket forming a manifold and attached to an under surface thereof of the toilet seat and which includes a number of rigid spacer members and a number of interconnecting passage ways forming the manifold which is in connection with a number of intake orifices formed on an interior side surface perimeter thereof in a manner such that in use the resilient manifold gasket seals the gap between the toilet seat and the commode bowl top edge. The manifold chamber is in communication with a common vent that is used to draw air from the commode bowl through the numerous inlet orifices to the manifold and out to a desired disposal area.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

It can be seen from-the following description that in use, a home owner or business owner would simply install the commode ventilation system by either attaching the ventilation system resilient gasket member to a bottom surface of a toilet seat or by replacing a toilet seat with a resilient gasket member formed in the toilet seat bottom surface therein. The user would then attach the modular vent duct connection at the rear of the resilient gasket member and connect the provided vent tube onto the tube flange. The vent tube would be connected to an existing vent fan which would pull air out of the toilet bowl through the hose anytime the bathroom vent fan is turned on. Use of the commode ventilation system would provide homeowners, business owners, and others with a practical device for removing odors efficiently and effectively from a toilet bowl.

Figure 1:
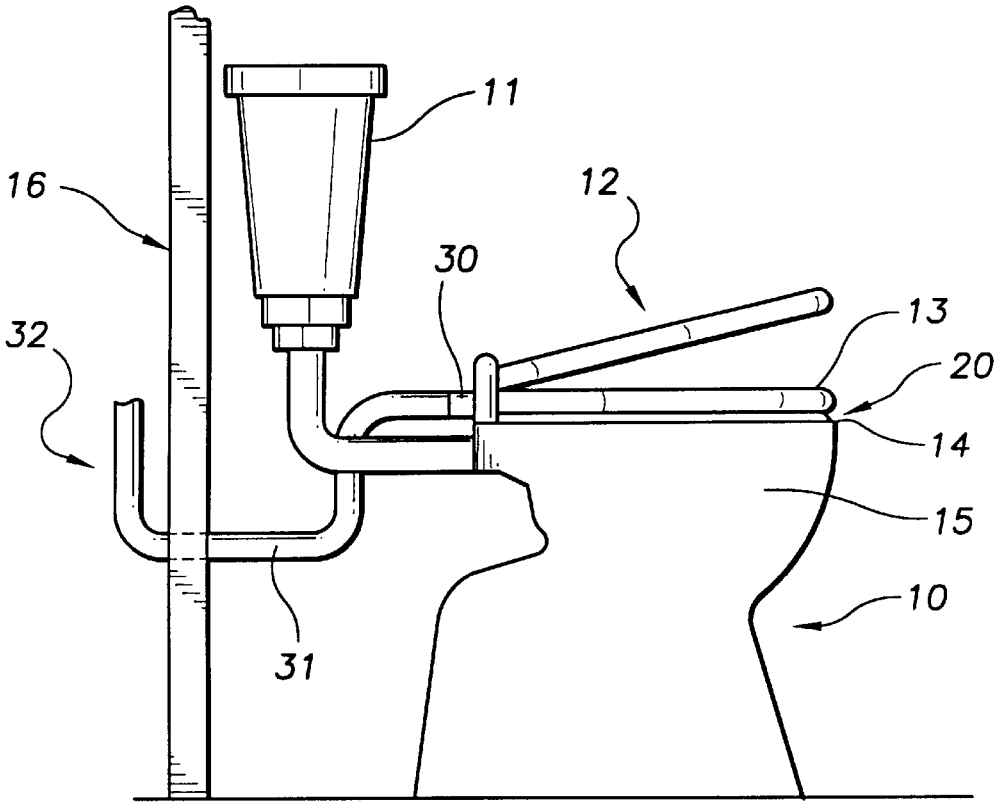
FIG. 1 is a side view of a conventional toilet installed with a commode ventilation system.

Referring to the figures in detail FIG. 1 illustrates a conventional household toilet 10 with a water holding tank 11 toilet lid 12, toilet seat 13, while the commode bowl ventilation system is installed with the resilient gasket member 20 installed between the toilet seat 13 and the top edge 14 of the toilet bowl 15. A vent tube flag 30 is installed at a back end of the resilient gasket member 20 and provides a connecting location for vent tube 31 which preferably extends through a bathroom wall 16 and therein connects to existing ventilation plumbing 32.

Figure 2:
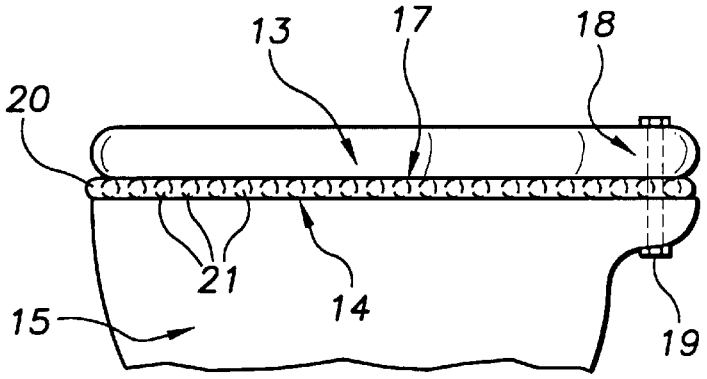
FIG. 2 is a close up side view of a conventional toilet with the commode ventilation system resilient gasket positioned between the toilet seat and the top edge of the commode bowl.
Figure 3:
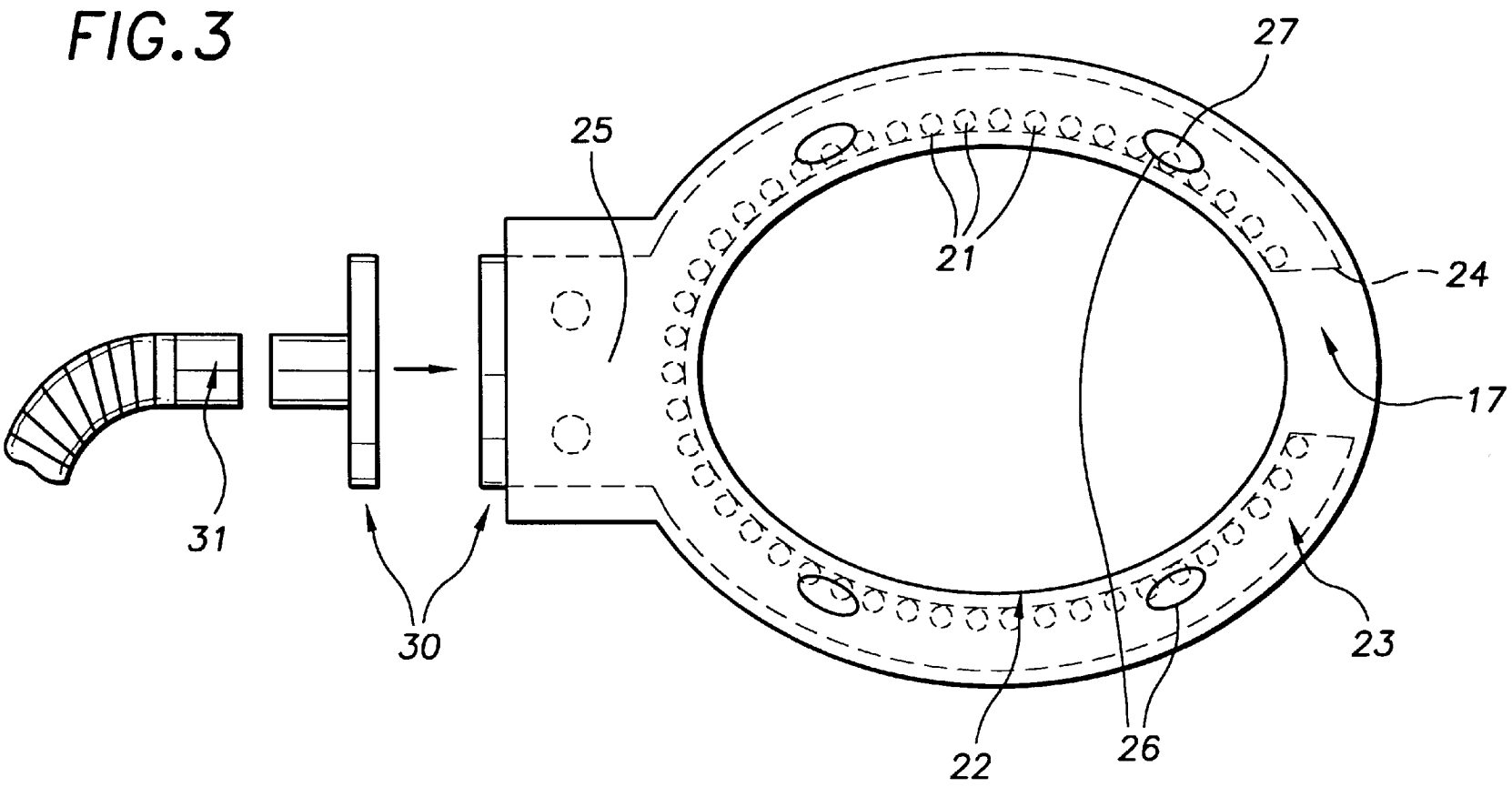
FIG. 3 is a top view of a toilet seat with the resilient gasket manifold member installed and the vent pipe connected thereon.

FIG. 2 illustrates an isolated side view of the resilient gasket member 20 installed between the toilet seat bottom surface 17 and the toilet bowl top edge 14. The back end 18 of the toilet seat which includes conventional securing bolts 19 provides a location for placement of the resilient gasket member mounting end. The resilient gasket member 20 includes numerous orifices 21 which are opened along an inside perimeter edge of the resilient gasket member. Referring to FIG. 3, which is a top cross sectional view of the resilient gasket member mounted to a bottom surface of the toilet seat, illustrating the numerous orifices 21 opened to an inside perimeter edge 22. The orifices 21 are in communication with an internal air passage way 23 which forms a manifold that extends from a front end 24 of the gasket member and provides an internal air passage way from the numerous air inlet ports 21 and an air manifold duct 25. The air manifold duct includes a mounting flange 30 that provides a connection flange for connecting tubing 31. The resilient gasket member 20 includes apertures 26 for allowing the passage of the toilet seat feet 27 through the resilient gasket member. Furthermore, the internal passage way 23 circumvents the toilet seat feet 27 so that the air flow from the numerous inlets 21 is not impeded.

The resilient gasket member 20 may be provided as an attachment which is secured to a bottom surface 17 of the toilet seat 13. The means for attaching the resilient gaskets includes adhesives, screws, and other means which would effectively bond a resilient gasket member to the bottom surface of the toilet seat. An alternative design includes supplying the resilient gasket member as part of a new toilet seat so that a user simply replaces the toilet seat by removing the conventional bolts 19. The vent flag 30 would be identical to either alternative of the resilient gasket member type. Additionally, the vent tube 31 preferably extends through a bathroom wall and is plumbed to connect to existing bathroom ventilation fans. The vent flange 30 is preferably elongated and flat so that the upper and back portion of the toilet seat is not impeded by the vent.

The resilient gasket member 20 is preferably constructed of neoprene rubber, or any other suitable, flexible rubber material and/or synthetic material which would lend itself to forming a good seal between the toilet seat and toilet bowl top edge. The resiliency of gasket member is important for the proper operation of the invention herein. When the toilet seat is lowered to a close a position the resilient gasket member preferably fills the gap between the toilet bowl and a top edge and the toilet seat. When the bathroom air vent fan is activated, air is drawn from the toilet bowl into the numerous orifices positioned on the interior perimeter edge of the resilient gasket member through the common air passage way in the resilient gasket member and into the flange and out the ventilation tube 31. The air flow through the commode ventilation system is not impeded by flushing the commode and since it includes numerous air passage ways around the entire internal perimeter of the toilet bowl, the ventilation system effectively draws all odors emanating from the toilet bowl.

It is noted that the embodiment of the commode ventilation system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A commode ventilation system for connection with a bathroom vent fan and a commode assembly including a toilet bowl, a commode tank and a toilet seat having a number of toilet seat feet for supporting the commode seat above the commode bowl; said commode ventilation system comprising:

a) a resilient gasket member attached to a bottom surface of a toilet seat and which forms a seal between the bottom surface of the toilet seat and a top edge of a toilet bowl when the toilet seat is lowered, numerous inlet ports formed in a inside perimeter edge of the resilient gasket member and which inlet ports open into a toilet bowl, an internal manifold formed by interconnecting the numerous inlet ports thereby forming a common air passageway for all the inlet ports to a common vent connection positioned near a back end of the resilient gasket member;

b) a common vent connected to the common vent connection of the resilient gasket member, the commode vent being connectable to a bathroom vent fan for drawing air through the inlet ports of the resilient gasket member in use;

the resilient gasket member further including passageways adapted to permit toilet seat feet to pass through the resilient gasket member without impeding the flow of air through the air passageway through the gasket member.

* * * * *